US005743062A

United States Patent [19]

Fricker

[11] Patent Number: 5,743,062

[45] Date of Patent: Apr. 28, 1998

[54] ANCHORING DEVICE FOR HOUSING/ BUILDING CONSTRUCTION

[75] Inventor: Siegfried Fricker, Heimsheim, Germany

[73] Assignee: Halfen GmbH & Co. Kommanditgesellschaft, Langenfeld-Richrath, Germany

[21] Appl. No.: 457,665

[22] Filed: Jun. 1, 1995

Related U.S. Application Data

[63] Continuation-in-part of Ser. No. 197,506, Feb. 15, 1994, abandoned.

[51] Int. Cl.[6] ..... E04B 1/38

[52] U.S. Cl. ..... 52/704; 52/710; 52/711

[58] Field of Search ..... 52/698, 704, 710, 52/711; 411/500, 501, 179, 180, 183, 107, 34; 248/58, 317, 916; 72/367

[56] References Cited

U.S. PATENT DOCUMENTS

| | | | |
|---|---|---|---|
| 4,052,833 | 10/1977 | Beine | 52/710 |
| 4,571,912 | 2/1986 | Fricker . | |
| 4,625,537 | 12/1986 | Aleck | 72/367 |
| 4,922,679 | 5/1990 | Fricker | 52/698 |

FOREIGN PATENT DOCUMENTS

| | | |
|---|---|---|
| 0275879 | 7/1988 | European Pat. Off. . |
| 2631396 | 7/1977 | Germany . |
| 2952700 | 7/1981 | Germany . |
| 3407801 | 6/1985 | Germany . |
| 3546107 | 6/1987 | Germany . |

*Primary Examiner*—Kien T. Nguyen
*Attorney, Agent, or Firm*—Robert W. Becker & Associates

[57] ABSTRACT

An anchoring device for housing/building construction has at least one anchoring member with a shaft and a first and a second end. The anchoring track to which the first end is form-fittingly connected has an inner and an outer surface. The second end has a fastening element for anchoring the device in a substrate such as concrete. At least the shaft is made of a pipe section. The anchoring track has an opening with an inner edge. The first end of the shaft penetrates the opening whereby the first end has at least one appendage formed at the free end penetrating through the opening, whereby the at least one appendage engages the opening from behind.

25 Claims, 4 Drawing Sheets

ANCHORING DEVICE FOR HOUSING/ BUILDING CONSTRUCTION

This application is a continuation-in-part of application Ser. No. 08/197,506 filed Feb. 15, 1994 now abandoned.

BACKGROUND OF THE INVENTION

The present invention relates to an anchoring device for housing/building construction with at least one projecting anchoring member having a shaft and a first end that is form-fittingly connected to the anchoring track and a free end that is provided with a fastening element.

Known anchoring devices of the aforementioned kind are comprised of substantially U- or C-shaped track profiles with two legs projecting from the back of the track that have free ends which are inwardly or outwardly bent. The back of the track is provided with openings at a predetermined distance into which massive anchor shafts, usually in the form of anchoring bolts, are fastened, for example, by material deformation, especially by cold forging of the bolt ends (feet) that extend through the holes into the interior of the track. The bolt ends (feet) are thus form-lockingly or form-fittingly anchored. The free end of the anchoring bolt opposite the end (foot) fastened to the anchoring track is provided with a thread onto which a nut is threaded or forged, thereby forming a fastening element (in the following referred to as the anchoring head). This anchoring head serves to anchor the anchoring device within the substrate, for example, concrete, such that the support loads of the anchoring device are distributed evenly via the anchoring bolt into the substrate.

From the prior art a great number of different anchoring devices are known, that for decades have been the standard in the art, which disclose a variety of form-locking (form-fitting) connections between the foot of the anchoring bolt and the opening within the back of the track in a technological simple and stable manner whereby for the free end of the anchoring bolt (the anchoring head) an embodiment is to be selected that simultaneously provides for an easy technical manufacture and for a reliable force transformation into the substrate. The known embodiments however have the disadvantage that for the reliable form-locking or form-fitting-type fastening of the anchor bolt in the opening of the anchoring track material deformation methods of the foot and the edges of the openings are being used that are difficult to perform and thus are technologically challenging and expensive, especially since the upwardly extending projections of the track must be formed in the shape of a collar with exact adaptation to the shape of the anchoring foot in a cold forming process. Such forming processes of the massive anchor bolt, especially within the area of the anchor foot, inclusive the surrounding wall portions, requires furthermore a cost-intensive use of corresponding machining tools. In order to reduce this expenditure and also the corresponding manufacturing costs, it is known from German Patent 34 07 801 to use premanufactured countersunk screws with a conical head. However, for using such screws the backwall portions of the anchoring track with the openings must be deformed such that they surround the conical portion of the countersunk screw uniformly gripped on all sides and have a transition into a neck having an axis of symmetry perpendicular to the longitudinal axis of the anchoring track and form-lockingly engaging the lower threaded portion of the bolt. For this purpose the formed neck must either be provided with an inner thread or a corresponding pressing of the neck onto the bolt shaft is required.

From German Offenlegungsschrift 35 46 107 an anchoring track for housing/building construction is known which is provided with upwardly oriented projections with openings in the back of the anchoring track. Into the projections a countersunk slant of the anchoring bolt is inserted. The inner surface of the opening rests due to material deformation in a press-fit at the mantle surface of the anchoring bolt. The inner surface of the opening is in the form of a truncated cone and has its greater diameter adjacent to the back of the anchoring track so that the resulting gusset will fill by cold forming an intermediate section of the anchoring bolt having a greater diameter and extending from the countersunk head. This is achieved by cold forging whereby the cold forging pressure is transmitted into the projection with a close adaptation to the shape of the countersunk screw.

It is an object of the present invention to provide an anchoring device of the aforementioned kind with which the extremely difficult, technically demanding material deformation is simplified and with which expensive anchoring material required for such anchoring devices can be saved, thus also reducing the weight of the anchoring bolts in comparison to the prior art anchoring bolts, however, without loosing the required great stiffness and resistance for such anchoring devices.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
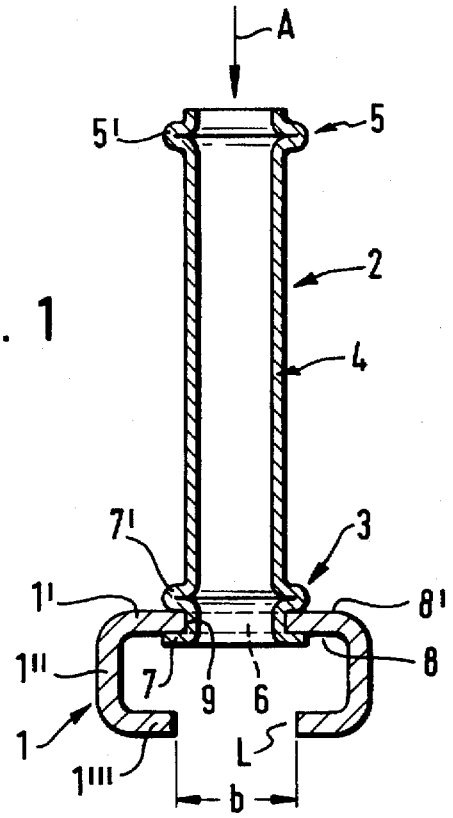
FIG. 1 shows, in a longitudinal section of the anchoring member and along the track perpendicular to its longitudinal section, an inventive anchoring device with an anchoring member having a anchor shaft of circular cross-section.
Figure 2:
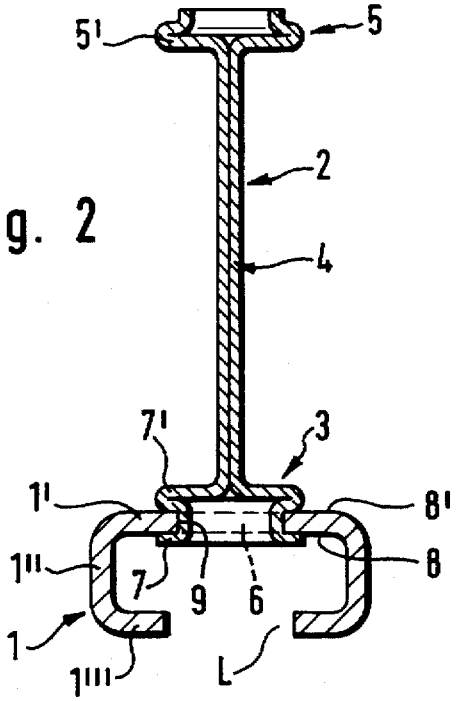
FIG. 2 shows an anchoring device represented in the same view as in FIG. 1 with a flat pressed anchoring shaft.

The anchoring device for housing/building construction according to the present invention is primarily characterized by:

At least one anchoring member having an anchoring shaft and a first end and a second end connected to said anchoring shaft;

An anchoring track, to which the first end is form-fittingly connected, having an inner and an outer surface;

The second end having a fastening element;

At least the anchoring shaft made of a pipe section.

Expediently, the anchoring track has an opening with inner edge, the first end penetrates the opening, and the first end has at least one appendage formed at a free end penetrating through the opening, the at least one appendage engaging the opening from behind.

Preferably, the first end has at least one projection extending substantially parallel to the at least one appendage, the at least one appendage and the at least one projection resting on the inner and outer surfaces of the anchoring track and engaging the inner edge of the opening on both sides. Preferably, the at least one appendage and/or the at least one projection are selected from the group consisting of a collar, a pawl, and a nipple.

Preferably, the at least one appendage and the at least one projection are formed by plastically deforming the first end. Advantageously, the at least one appendage and the at least one projection are formed by cold forging the first end. In the alternative, the at least one appendage and the at least one projection are formed by flanging the first end. Both methods of plastically deforming can also be combined for the purpose of plastically deforming the appendage and the projection.

Advantageously, the at least one projection is a collar having a substantially oval shape, wherein the longer axis of the oval shape extends in the longitudinal direction of the anchoring track.

Advantageously, the anchoring track has a longitudinal slot opposite the opening and the at least one appendage projects, in a direction transverse to the longitudinal slot, beyond a width of the longitudinal slot.

Expediently, the opening has a recessed edge portion for receiving the appendage such that the appendage, when positioned in the recessed edge portion, is substantially flush with the inner surface of the anchoring track.

Expediently, the anchoring shaft has a middle section that is at least partially pressed flat to form flat wall sections. The anchoring shaft is preferably pressed flat over the entire length thereof.

Advantageously, the flat wall sections are spaced at a distance from one another. Preferably, the flat wall sections extend over an entire length of the shaft and are positioned closely adjacent to one another. Alternatively, the flat wall sections may abut at one another and, when viewed in cross-section, each have at least one projection. The wall sections preferably each have two of the projections extending symmetrical to one another. Preferably, the wall sections have substantially flat portions and the projections are rib-shaped and positioned adjacent to the flat portions. Advantageously, the projections are rounded. In a preferred embodiment of the present invention, one of the flat portions is positioned between two of the projections.

Advantageously, the shaft has a cross-section selected from the group consisting of a circular shape, an oval shape, a square shape, and a polygonal shape.

In a preferred embodiment of the present invention, the anchoring shaft is at least partially pressed flat and has a substantially conical tapering longitudinal cross-section between the first end to the second end. In another embodiment of the present invention, the anchoring shaft is at least partially pressed flat and has a substantially diamond-shaped longitudinal cross-section between the first end to the second end.

Expediently, the fastening element when viewed in an axial direction of the anchoring shaft is wider than the anchoring shaft.

Preferably, the fastening element is formed as a unitary part from the anchoring shaft. The fastening element is preferably formed as a double collar. The fastening element, the anchoring shaft, and the first end are expediently made by plastically deforming the pipe section. Preferably, the pipe section has a cross-section selected from the group consisting of a circular shape, an oval shape, a square shape, and a polygonal shape.

According to the present invention, the anchoring device has at least one anchoring shaft and a first end that is fixedly connected to the anchoring track and a second end that is provided with a fastening element for fastening or anchoring the anchoring device in the substrate, for example, concrete, wherein it is inventively suggested that at least the anchoring shaft is made of a pipe section. The inventive embodiment of providing the anchoring shaft as a pipe section results in the advantage that the expensive, massive anchoring bolts previously used for anchoring members, especially in the form of prefabricated countersunk screws, can be disposed of so that material and weight of the anchoring device are reduced. Furthermore, the pipe section, depending on the desired application, can be easily cut to length from a blank and connected to the back of the anchoring track in a suitable manner so as to be form-locked. Advantageously, this can be achieved by providing an opening in the back of the anchoring track through which the end of the pipe section penetrates. The opening is engaged by at least one appendage, preferably two parallel extending appendages/projections, that are formed by plastically deforming, for example, by cold forging or flanging, and are in the form of a collar, finger-shaped pawls, nipples etc. With this embodiment, the anchoring shaft is form-lockingly connected to the anchoring track with the engaging projections/appendages resting at the inner and outer surfaces of the anchoring track. The edge of the opening in the anchoring track is engaged on both sides with sufficient material in a fixed and undisplaceable manner.

In a preferred embodiment of the present invention the tubular anchoring shaft between the first end and the second end, i.e., in the middle section, is at least over a part thereof, preferably over its entire length, pressed flat. For generating the desired stiffness, different embodiments are possible. For example, the flat wall sections resulting from the pressing step may be positioned at a predetermined distance to one another or, for increasing the stiffness, they may be additionally provided with ribs. Upon pressing the wall sections together, it is suggested to provide profilings. For example, the cross-section of such flat-pressed wall sections may be oval or in the shape of a FIG. 8, but may also be angular or square. The anchoring shaft may have a cross-section that is circular, oval, or substantially square or polygonal. In an especially preferred embodiment of the present invention, the fastening element of the anchoring shaft, the first end to be connected to the anchoring track, and the anchoring shaft between these two parts can be formed by deforming one single pipe section of a circular, oval, or angular cross-section.

DESCRIPTION OF PREFERRED EMBODIMENTS

The present invention will now be described in detail with the aid of several specific embodiments utilizing FIGS. 1 through 7.

In FIGS. 1 to 7 anchoring devices are shown that each have a track 1 with a substantially U-shaped cross-section whereby the back of the anchoring track is indicated at 1', the legs are indicated at 1" and the inwardly extending free ends of the legs 1" are indicated at 1'''. These free ends 1''' delimit a longitudinal slot L of the anchoring track having a width b. The back 1' of each anchoring track is provided with openings 6 spaced in the longitudinal direction from one another. In each opening 6 a tubular anchoring member 2 with its anchoring shaft 4 and first and second ends 3 and 5 is connected via the first end (bottom) 3 in a form-locking manner. Connected to the bottom 3 is the anchoring shaft 4. The anchoring member 2 is preferably comprised of a plastically deformed, initially tubular pipe section. At the free end of the anchoring shaft 4 a fastening element 5 for fixedly connecting the anchoring device 2 within the substrate such as concrete is provided. The fastening element 5 is wider than the anchoring shaft 4 such that in the axial direction of the anchoring shaft 4 (arrow A in FIG. 1) the fastening element projects with its edges past the cross-section of the anchoring shaft 4 in a sufficient amount, depending on the required fastening conditions. The anchoring shaft 4, as in shown in FIGS. 1, 7, and 12, may have a circular or oval cross-section. However, it is also possible to use a square or polygonal shaft. FIGS. 2 to 6 show anchoring shafts 4 that are formed by pressing flat a pipe section of a pipe with a round cross-section.

As can be seen in FIGS. 1 to 5, the first end 3 of the anchoring shaft 4 penetrates the opening 6 and extends into the anchoring track 1 so as to be form-lockingly fastened at the inner side of the back 1' of the anchoring track. The free end of the anchoring shaft 4 penetrating into the interior of the track 1 engages with a formed collar 7 positioned inside the track 1, the wall, respectively, the edge 9 of the opening 6 in a form-locking and fast manner. The edge 9 of the opening 6 is furthermore form-lockingly engaged by a cold-forged projection collar 7' of the anchoring shaft 4 that is resting on the back 1' of the track 1. Two parallel extending collars 7, 7' rest closely on the inner side 8 and the outer side 8' of the back of the anchoring track 1 and enclose together the edge 9 of the opening 6 such that the first end 3 of the shaft is securely fastened within the anchoring track 1. Instead of the round collars 7, 7' it is possible to use any other forms of appendages or projections, for example, finger-shaped pawls, nipples, and any other suitable protrusion.

The collars 7, 7', are formed by plastically deforming the tubular lower portion of the first end 3 of the anchoring shaft 4 which is preferably achieved by cold pressing (forming), for example, by means of cold forging, whereby the collars 7, 7' are formed by beading.

Figure 3:
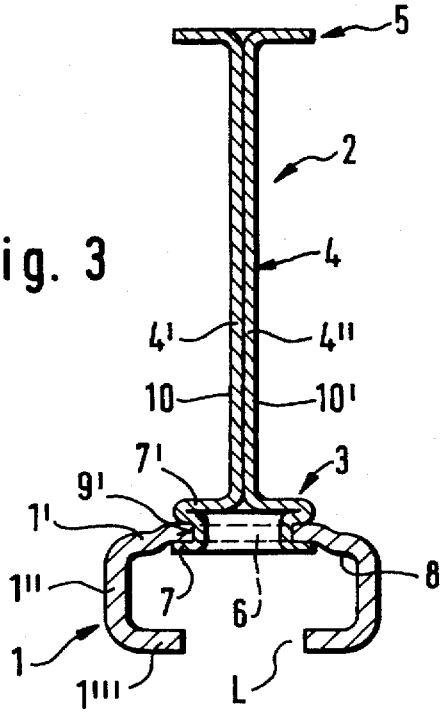
FIG. 3 shows an anchoring device in a longitudinal section as shown in FIG. 1 with another embodiment of the fastening element.
Figure 8:
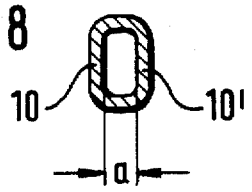
FIGS. 8 to 12 show different possible cross-sections of the anchoring shaft.
Figure 9:
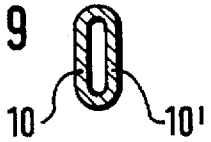

In a preferred embodiment of the invention, the tubular anchoring shaft 4 at its middle section is at least partially pressed flat, preferably over its entire length, i.e., in the area between the first end 3 and the fastening element 5, as shown in FIGS. 2 to 6. Due to pressing flat the anchoring device 2 a high stiffness for a comparatively low wall thickness results. The inventive anchoring devices are therefore less obstructive with respect to arrangement within reinforcements of the substrate (concrete). Due to the inventive plastic deformation the anchoring shaft 4 can be provided with any suitable cross-sectional profile depending on the starting material, respectively, the desired application. For example, the flat pressed wall sections 10, 10' of the anchoring shaft 4, as represented in FIG. 3, may have in another embodiment a predetermined distance a relative to one another (as shown in FIG. 8) or may be pressed together, as is shown in FIG. 9.

Figure 11:
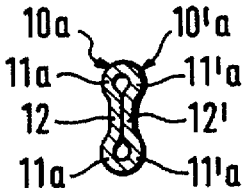
Figure 10:
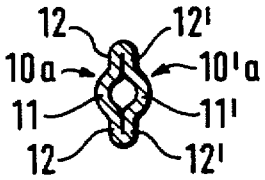
Figure 12:
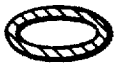
Figure 6:
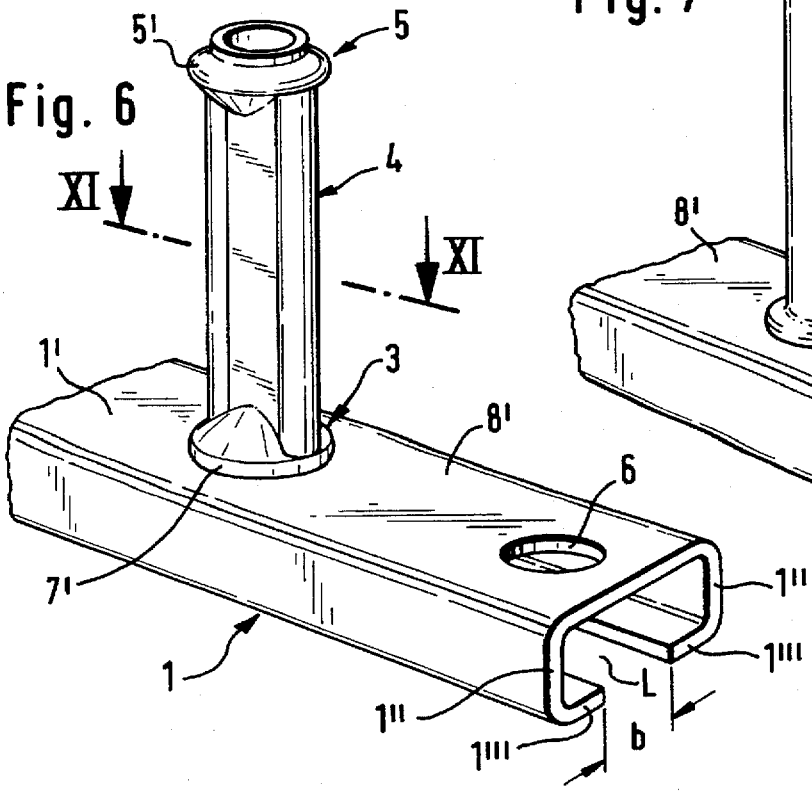
FIG. 6 shows a perspective view of a section of an anchoring device, the shaft of which is shown in cross-section in FIG. 11.
Figure 7:
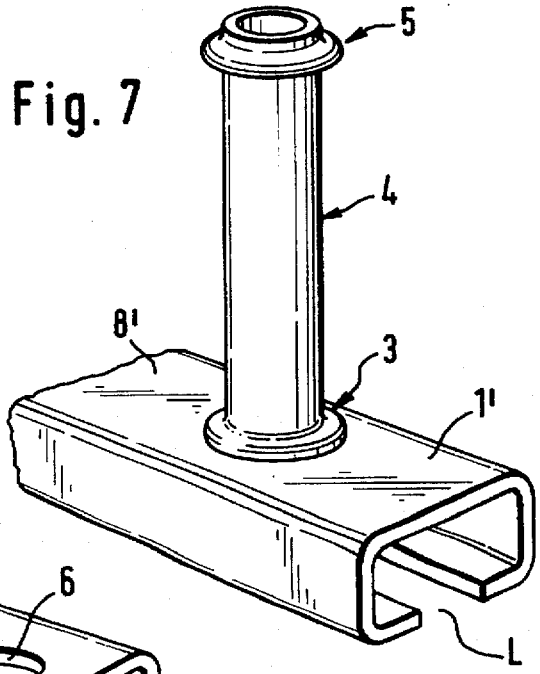
FIG. 7 shows a perspective view of an anchoring device according to FIG. 1.

The tubular anchor shaft may also be pressed together in such a manner that wall sections 10*a*, 10'*a* result which, when viewed in cross-section, have at least one, preferably, two or more symmetrically extending rib-shaped projections, respectively, longitudinal profiles for increasing the stiffness of the shaft as, for example, shown in FIGS. 10 and 11. The rib-shaped longitudinal profiles 11 and 11' (FIG. 10), respectively, 11*a* and 11'*a* (FIG. 11) may be rounded for the purpose of reducing the risk of rupture or breakage and may be arranged adjacent to, respectively, between flat wall sections 12, 12', as shown in FIGS. 10 and 11. In the embodiment according to FIG. 11 between two oppositely arranged ribs 11*a*, 11'*a* portions, which in cross-section are substantially circular, flat longitudinal sections 12 and 12' are positioned so that the flat-pressed tubular section in cross-section has a shape as shown in FIG. 6. FIG. 12 shows a cross-section of a tubular anchoring shaft 4 with an oval cross-section.

Figure 4:
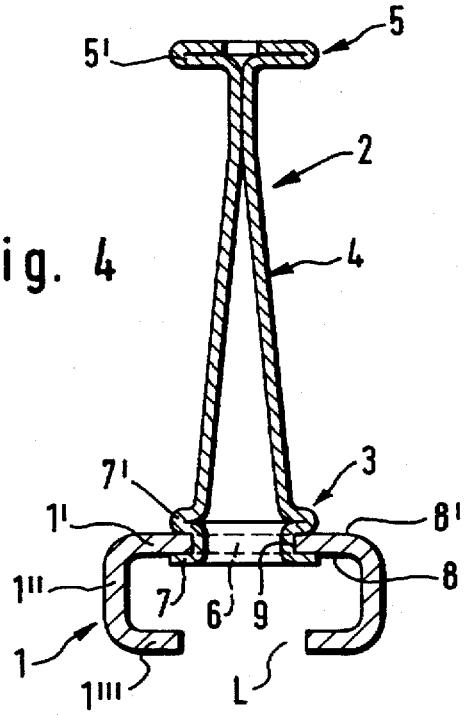
FIG. 4 shows in longitudinal section as in FIG. 1 an anchoring device with a further embodiment of the anchoring member.
Figure 5:
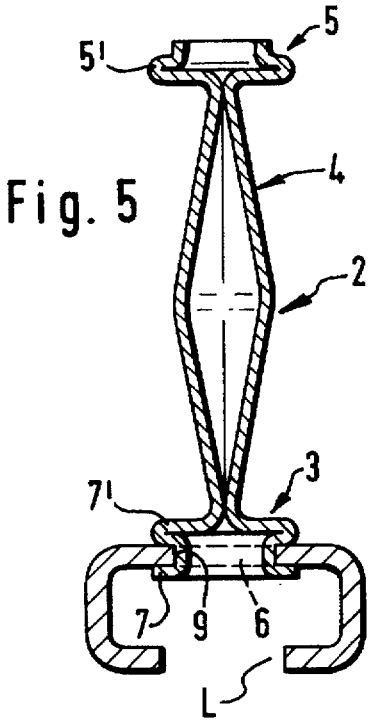
FIG. 5 shows an anchoring track of the anchoring device in longitudinal section as in FIG. 1 with a substantially diamond-shaped deformation of the anchoring shaft.

Depending on the requirements with respect to stiffness, material, and/or application, different cross-sectional shapes of the anchoring shaft 4 to be pressed can be manufactured. FIG. 4 shows the result of deforming a tubular anchoring shaft 4 that extends between the first end 3 to the fastening element 5 in a conically tapering manner. In FIG. 5 an embodiment is shown in which the flat-pressed shaft 4 has a substantially diamond-shaped longitudinal cross-section between the first end 3 and the fastening element 5.

The fastening elements 5 at the end of the anchoring shaft 4, as mentioned before, are wider than the anchoring shaft 4 and, in a preferred embodiment of the present invention, are formed by cold forging from the anchoring shaft 4 such that a wider double collar 5 is formed as shown in cross-section in FIGS. 1, 2, 4, and 5. In the embodiment of FIG. 3 the fastening element 5 is formed during cold forging by a single bending step of abutting wall section 4' and 4" of the anchoring shaft 4. Instead of a deformation of the fastening element it is also possible to provide a separate element to be connected to the anchoring shaft 4.

An especially favorable embodiment of an anchoring device is provided when the anchoring member 2, comprised of the fastening element 5, the shaft 4, and the first end 3 for anchoring is made by forming a single tubular section with a suitable, i.e., round, oval, square cross-section. The form locking connection between the first end 3 and anchoring track 1 can be provided with an especially great stiffness when at least the appendage 7, i.e., the collar, nipple, or pawl, which engages the opening 6 within the anchoring track 1 from behind, is provided with a size that is greater than the width b of the longitudinal slot L of the anchoring track 1. This is possible when the rolling press has at least substantially a diameter of the width b of the longitudinal slot 1, so that during cold forging or forming the projecting free end of the shaft 4 is exposed to the greatest possible flanging.

As shown in FIG. 3, the anchoring track 1 can maintain provided with its full inner diameter despite the arrangement of projections/appendages, for example, in the form of collars 7, achieved by deforming the edge portion of the opening 6 outwardly such that the formed collar 7 is positioned approximately flush with the inner side of the anchoring track 1. As shown in FIG. 6, the collar 7' resting on the outer side 8' of the anchoring track 1 is formed so as to be oval whereby its longer axis is arranged in the longitudinal direction of the anchoring track 1. In order to maintain the greatest possible free diameter of the anchoring track, it is suggested that the collar 7 which is circular or oval and which is positioned at the inner side 8 of the anchoring track 1 is as flat as possible such that it projects only to a small extent, preferably only a few millimeters, past the inner surface 8 of the anchoring track 1 into the interior.

Figure 13:
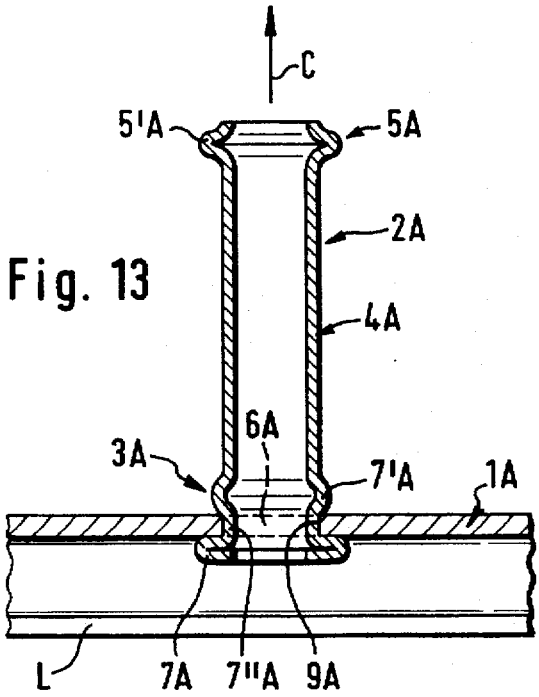
FIG. 13 shows an anchoring device with an anchoring member with a tubular shaft in longitudinal section parallel to the longitudinal slot of the track.

FIGS. 13 to 16 show further embodiments of the anchoring device. In FIG. 13 the anchoring track 1A with the anchoring member 2A is shown in longitudinal section parallel to the axis of the longitudinal slot L of the anchoring track 1A. The anchoring member 2A is produced from a pipe section that has in cross-section a circular or oval shape and is deformed at its first and second ends by cold forging to form the head portion (second end) 5A and the bottom portion (first end) 3A. Between the bottom portion 3A and the head portion 5A extends a shaft 4A which still has the cross-section of the non-deformed pipe section. The head portion 5A is formed by cold forging and is comprised of a double collar 5'A which has a transition into an upwardly open annular neck portion. The bottom 3A is comprised of a double collar 7A positioned within the anchoring track and an exterior collar 7'A positioned exterior to the anchoring track 1A as well as a part 7"A connecting the two collars which is pressed into an opening 6A of the anchoring track 1A. The two collars 7A and 7'A engage together with the part 7"A the edge 9A of the opening 6A in a positive locking (form-locking) manner. This positive locking is produced by cold forging the pipe section.

The embodiment of the bottom 3A with the inwardly positioned double collar 7A results in a high pulling resistance of the anchoring member 2A which, when the anchoring device is in use, is primarily loaded in the direction C. The anchoring member 2A has furthermore a high bending resistance, especially in the correspondingly loaded area of the bottom 3A, because it is embodied as a hollow body.

Figure 15:
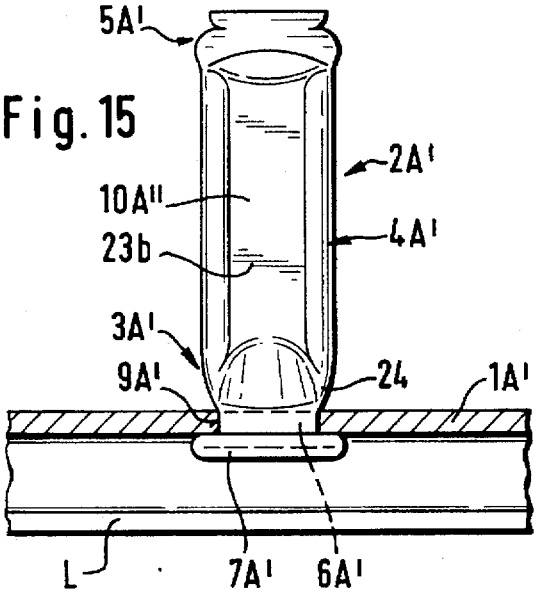
FIG. 15 shows the anchoring device of FIG. 14 in longitudinal section parallel to the longitudinal slot of the track.
Figure 14:
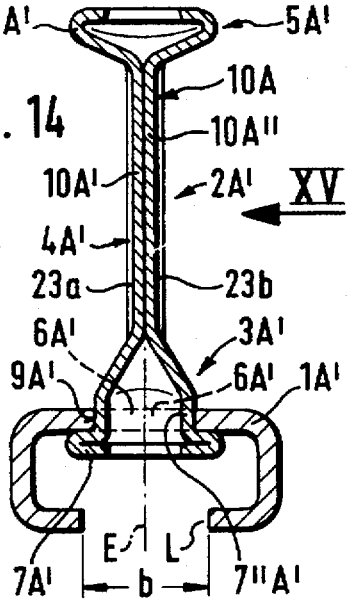
FIG. 14 represents an anchoring device with anchoring member having a shaft that is pressed flat, shown in longitudinal section perpendicular to the longitudinal slot of the track.

FIGS. 14 and 15 show an anchoring device with a different embodiment of the anchoring member in longitudinal section perpendicular, respectively, parallel to the longitudinal slot L of the anchoring track 1A. This anchoring member 2A' is also produced from a pipe section whereby however the tubular wall 10A in the area of the anchoring shaft 4A' is pressed together so that this anchoring shaft 4A' is comprised of two closely positioned wall sections 10A' and 10A". The bottom 3A' has, as in the embodiment of FIG. 13, a double collar 7A' positioned within the track 1A' which has a transition into the part 7"A' that is tightly resting on the edge 9A' of the opening 6A'. Starting at this part 7"A' the portion of the pipe section which belongs to the bottom 3A' tapers conically upwardly (in section according to FIG. 14) or widens (in section according to FIG. 15) so that the anchoring device laterally rests with these widened portions extending in the longitudinal direction of the track on the upper edge of the opening 6A'.

The head 5A' of the anchoring member 2A' is in the form of a double collar 5'A' similar to the anchoring member of FIG. 13 whereby however, by compressing the tubular wall, an oval shape of the head results.

All anchoring members 2A' are connected to the anchoring track 1A' such that the flat anchoring shaft 4A' extends with its wide side in the direction of the longitudinal axis of the anchoring track. The longitudinal center plane of the anchoring device in which the two wall sections 10A' and 10A" abut one another, is located in the longitudinal center plane E of the anchoring track 1A'. However, the anchoring members could also be positioned such that they are rotated about 90° or alternatingly rotated about 90°.

Figure 16:
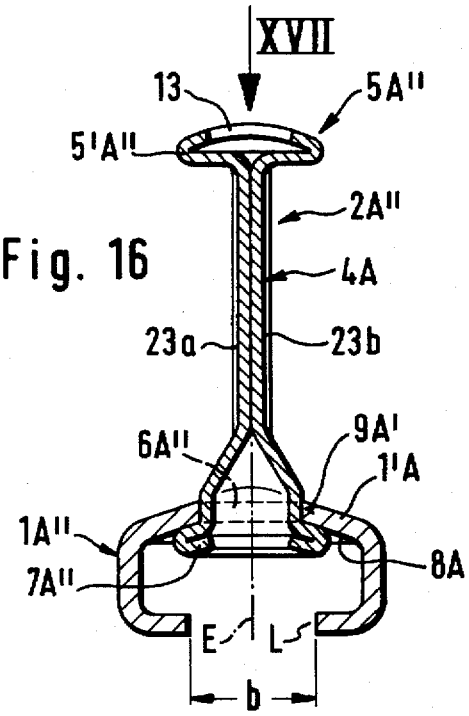
FIG. 16 shows an anchoring device with anchoring member in section as in FIG. 14 but with a different embodiment of the second end.
Figure 17:
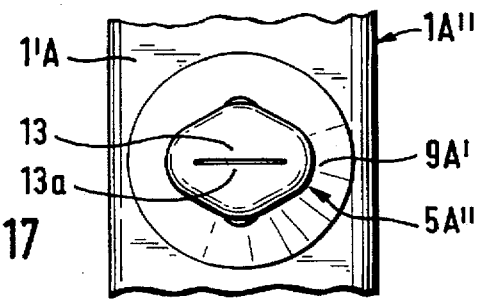
FIG. 17 shows a plan view of the anchoring device in the direction of arrow XVII in FIG. 16.

FIGS. 16 and 17 show an anchoring track with an anchoring member 2A" which differs from the anchoring device of FIGS. 14 and 15 in the design of the head 5A". The double collar 5'A" is formed such that its two exterior legs 13 and 13A border one another at the center of the head, as shown in the plan view of FIG. 17. Thus, the head 5A" is closed so that upon fastening the anchoring member 2A" in concrete no concrete material can enter the hollow space of the anchoring member. This embodiment of the head is also expedient for storage in order to prevent soiling of the interior of the anchoring member. The head 5A" in a plan view (FIG. 17) is, due to the deformation of the pipe section by compressing, substantially oval.

In the embodiment of FIG. 16 the anchoring track 1A" is provided with an outwardly oriented projection 9A' in the area of the opening 6A" in which the inner double collar 7A" is arranged in a sunken manner. The projection 9A' can be of such a size that the double collar 7A" is positioned flush with the inner surface 8A of the back of the anchoring track 1'A. However, it is also possible, as shown in FIG. 16, to provide an inwardly oriented projecting portion of the double collar 7A". The projection 9A' tapers conically upwardly. The sunken arrangement of the double collar 7A' results in the greatest possible free space within the anchoring track 1A".

The represented anchoring tracks are designed such that the diameter of the inner double collar of the bottom of the anchoring member is greater than the width B of the longitudinal slot L of the anchoring track. Due to this embodiment an especially high pulling resistance of the anchoring member pressed into the anchoring track is achieved. The method for producing the anchoring device according to FIGS. 14, 15 and 16, 17 will be explained with the aid of FIGS. 18 and 19.

Figure 18A:
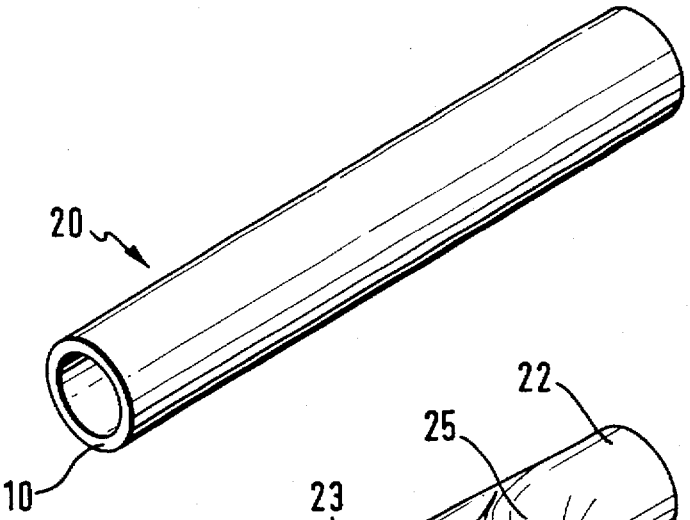
FIGS. 18*a–c* show the manufacture of the anchoring device of FIGS. 14–16 in various stages of the manufacturing process.
Figure 18B:
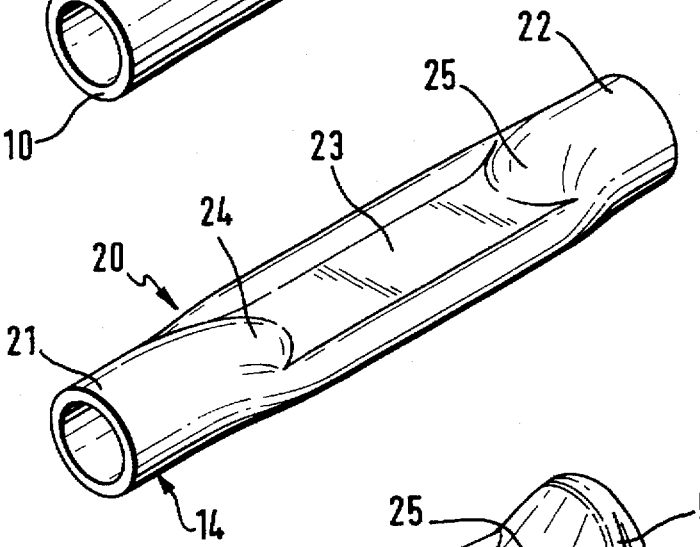
Figure 18C:
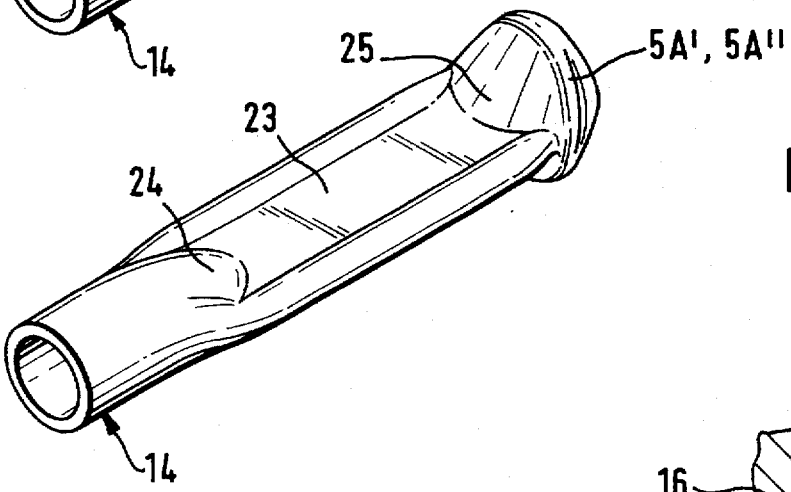

In a first method step a pipe section 20 is cut to length from a pipe which in the shown embodiment is cylindrical (FIG. 18*a*). The cross-section of the pipe section 20 is slightly smaller than the cross-section of the opening in the anchoring track whereby the two cross-sections have a matching shape.

In the following method step (FIG. 18*b*) the center section 23 of the pipe section 20 is deformed such that the two wall sections 10A' and 10A" (FIG. 14) which are resting on one another are formed. The two ends 21 and 22 of the pipe section 20 remain unchanged so that in the direction toward the two flat exterior sides 23A and 23B (compare FIG. 14 and FIG. 16) of the center portion 23 a substantially conical transition area 24, respectively, 25 results. The lateral edge portions of the flattened central portion 23 extend in the direction toward the two ends 21 and 22 so as to slightly taper conically.

In the subsequent method step (FIG. 18*c*) the head of the anchoring member is formed by cold forging the end 22 whereby after the selected cold forging step the head 5A' or the closed head 5A" (FIGS. 14 and 16, respectively) result as double collars.

Figure 19:
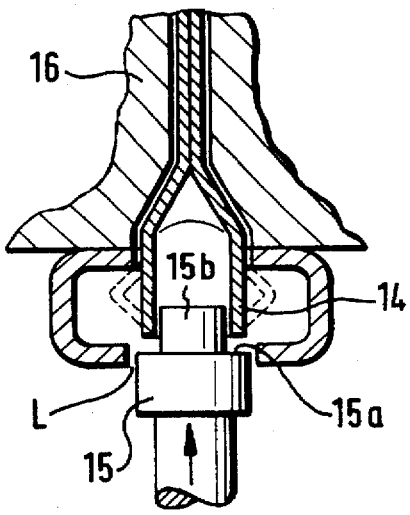
FIG. 19 shows schematically the arrangement for forming the first end of the anchoring member.

At the thus preformed anchoring member the end 21 forms a bottom 14 which can be inserted through the openings 6A', respectively, 6A" of the anchoring track so that the bottom 14 is positioned within the anchoring track as shown in FIG. 19. The pre-formed anchoring member rests with the widened edge sides of the transition portion 24 on the upper rim of the edge 9A' of the opening 6A', respectively, 6A". The pre-formed anchoring member is held in this position by a seat stone 16 which is adapted in its shape to (matches) the pre-formed anchoring member. Subsequently, a die 15 is introduced through the longitudinal slot L of the anchoring track which die 15 is provided at its end face 15A with a projecting punch 15B. This punch 15B engages the hollow space of the bottom 14 whereby the end face 15A of the die 15 rests at the annular end face of the bottom 14. By applying pressure with the die 15, the bottom 14 is deformed such that first an outward curving of the tubular wall results which is indicated by a dashed line. Upon further introduction of the die 15 into the anchoring track, the tubular wall of the bottom 14 is finally deformed to form the double collar 7A', respectively, 7A".

Due to this deformation of the correspondingly long bottom 14, it is possible to size the double collar 7A', 7A" such that its diameter is greater than the width B of the longitudinal slot L of the anchoring track.

During shaping of the double collar 7A', 7A" the part 7"A' is simultaneously subjected to radial pressure within the opening 6A' (FIG. 14) so that it is fixedly pressed into the opening of the anchoring track. The deformation of the pipe section ha been described with a plurality of deformation steps in conjunction with the drawings FIGS. 18 and 19 in order to facilitate understanding of the invention. However, in practice, the various deformation steps are carried out in one single work step. For this purpose, the pipe section blank, i.e., the not yet deformed pipe section, is introduced into the respective opening 6A' of the anchoring track 1A' so that the first end 14 is positioned within the anchoring track (FIG. 19). Subsequently, the two jaws of the seat stone 16 are moved toward one another whereby the tubular wall of the pipe section is pressed within the central portion 23 (FIG. 18*c*) so that the deformed pipe section rests with its narrow sides of the area 24 on the edge of the opening (see FIG. 15). The pipe section is secured in this position by the seat stone 16, and with a single cold forging step the head portion 5A', 5A" as well as the bottom with double collar 7A', 7A" are formed. The manufacture is expediently automated. The pipe sections are then introduced into the correspondingly positioned anchoring track with the aid of a dropping device. The processes of pressing and cold forging are performed automatically in a controlled fashion. The entire manufacturing process from insertion of the anchoring member to completion takes only a few seconds.

The present invention provides an anchoring track in which the anchoring member itself, due to the use of a pipe section, can be manufactured with comparatively low deformation forces and accordingly with simpler machines as compared to the prior art in few deformation steps from the tubular material with reduced manufacturing times and material savings without impairing the stability and stiffness of the anchoring device.

The present invention is, of course, in no way restricted to the specific disclosure of the specification and drawings, but also encompasses any modifications within the scope of the appended claims.

What I claim is:

1. An anchoring device for building construction, said anchoring device comprising:

a C-shaped anchoring track with a continuous longitudinal slot;

at least one anchoring member comprised of a pipe section and having an anchoring shaft with a first end and a second end;

said anchoring track having an opening for each one of said anchoring members;

said first end of said anchoring member connected to said opening by plastically deforming by beading said first end so as to enclose positive lockingly the edge of said opening;

said second end having a fastening element; and wherein said first end has a first beaded collar resting on an inner side of said anchoring track, said first beaded collar having a greater diameter than a width of said longitudinal slot.

2. An anchoring device according to claim 1, wherein said opening for receiving said beaded collar has an edge portion with an outwardly oriented recess wherein said beaded collar is positioned sunken in said recess.

3. An anchoring device according to claim 1, wherein said anchoring shaft has a middle section, extending between said first and said second end, that is at least partially pressed flat to form flat wall sections.

4. An anchoring device according to claim 3, wherein said anchoring shaft is pressed flat over an entire length of said middle section.

5. An anchoring device according to claim 3, wherein said flat wall sections are spaced at a distance from one another.

6. An anchoring device according to claim 3, wherein said flat wall sections of said anchoring shaft are positioned closely adjacent to one another.

7. An anchoring device according to claim 3, wherein said flat wall sections abut one another and, when viewed in cross-section, have a rib-shaped longitudinal profile.

8. An anchoring device according to claim 3, wherein said flat wall sections have at edges thereof two rib-shaped longitudinal projections extending symmetrical to one another.

9. An anchoring device according to claim 3, wherein said anchoring shaft has a transition into said first end and wherein said transition has an oval cross-sectional shape.

10. An anchoring device according to claim 9, wherein said first end has an outer contour of a substantially oval shape, wherein a longer axis of said oval shape extends in a longitudinal direction of said anchoring track.

11. An anchoring device according to claim 9, wherein said anchoring shaft tapers conically in a direction from said first end to said second end.

12. An anchoring device according to claim 3, wherein said anchoring shaft has a substantially diamond-shaped longitudinal cross-section in a direction from said first end to said second end.

13. An anchoring device according to claim 1, wherein said fastening element, when viewed as an axial direction of said anchoring shaft, is wider than said anchoring shaft.

14. An anchoring device according to claim 13, wherein said fastening element is formed as a unitary part from said pipe section of said anchoring shaft.

15. An anchoring device according to claim 14, wherein said fastening element has a double collar.

16. An anchoring device according to claim 1, wherein said first end after beading comprises a second beaded collar and wherein said first and second beaded collars are parallel to one another.

17. An anchoring device according to claim 16, wherein said anchoring track has an inner and an outer surface and wherein said first collar rests at said inner surface and said second collar rests at said outer surface.

18. An anchoring device according to claim 1, wherein said first beaded collar is a beaded double collar engaging said edge of said opening from the interior of said anchoring track.

19. An anchoring device according to claim 1, wherein said anchoring shaft between said first end and said second end has a cross-section identical to the cross-section of said non-deformed pipe section.

20. An anchoring device according to claim 1, wherein the tubular wall of said pipe section of said anchoring shaft is pressed together at least in a transition zone to said first end so as to have a larger cross-sectional diameter in one direction than said opening.

21. An anchoring device according to claim 20, wherein said anchoring member is arranged at said anchoring track such that said larger cross-sectional diameter of said pressed-together transition zone is aligned in the longitudinal direction of said anchoring track.

22. An anchoring device according to claim 21, wherein said transition zone has a substantially oval-shaped cross-section.

23. An anchoring device according to claim 20, wherein said pipe section of said anchor shaft is pressed together over its entire length between a transition to said first end and a transition to said second end to form flat wall sections, wherein said flat wall sections are positioned closely adjacent to one another.

24. An anchoring device according to claim 1, wherein said fastening element forms a head portion of said anchoring member, said head being in the shape of a double collar that is outwardly closed.

25. An anchoring device according to claim 24, wherein said head portion in an end view is oval and wherein ends of said head portion are bent toward one another so as to abut.

* * * * *